US005759069A

United States Patent [19]

Kitatani et al.

[11] Patent Number: 5,759,069

[45] Date of Patent: Jun. 2, 1998

[54] MULTIPOLAR ELECTRICAL PLUG

[75] Inventors: Haremi Kitatani, Higashiosaka; Koji Matsumoto, Ikoma, both of Japan

[73] Assignee: Hosiden Corporation, Osaka-fu, Japan

[21] Appl. No.: 679,797

[22] Filed: Jul. 15, 1996

[30] Foreign Application Priority Data

Sep. 25, 1995 [JP] Japan ..... 7-246260

[51] Int. Cl.[6] ..... H01R 17/18

[52] U.S. Cl. ..... 439/675; 439/580

[58] Field of Search ..... 439/580, 581, 439/675, 738, 693, 694, 668, 669

[56] References Cited

U.S. PATENT DOCUMENTS

| | | | |
|---|---|---|---|
| 1,026,238 | 5/1912 | Andersen | 439/675 |
| 3,475,719 | 10/1969 | Akin et al. | 439/668 |
| 3,760,338 | 9/1973 | Bruels | 439/694 |
| 3,950,069 | 4/1976 | Wiley | 439/694 |
| 4,955,828 | 9/1990 | Gruenberg | 439/668 |
| 4,976,632 | 12/1990 | Riches et al. | 439/580 |

FOREIGN PATENT DOCUMENTS

| | | | |
|---|---|---|---|
| 2085676 | 4/1982 | United Kingdom | 439/675 |

*Primary Examiner*—Gary F. Paumen
*Assistant Examiner*—Tho Dac Ta
*Attorney, Agent, or Firm*—Jones, Tullar & Cooper, P.C.

[57] ABSTRACT

A multipolar electrical plug (multipolar plug) which uses a multipolar electrical jack (multipolar jack) as a counter electrical connector so that, even when a plug is of a multipolar type, the length of the plug can be shortened. In addition, it is possible to enhance resistance to deformation and resistance to breakage of the pole portion. The multipolar plug is useful as a multipolar electrical connector to be used in the case where a space for insertion and ejection is required to be as small as possible, such as the case of an audio apparatus and a car navigation apparatus mounted on an automobile. The multipolar plug has the body, a pin pole protruding from the body, a plurality of sleeve poles which are respectively formed of a plurality of cylinders disposed in a coaxial manner with respect to the pin pole, and which protrude from the body. It is preferable to locate the front end position of the pin pole at a position which is recessed from the front end positions of the sleeve poles. The body may be continuously integrated with a neck portion having a bent shape.

8 Claims, 7 Drawing Sheets

MULTIPOLAR ELECTRICAL PLUG

BACKGROUND OF THE INVENTION

1. Field of the Invention

The present invention relates to a multipolar electrical plug (hereinafter referred to as "multipolar plug") which uses a multipolar electrical jack (herein-after referred to as "multipolar jack") as a counter electrical connector. Such a multipolar plug is useful as a multipolar electrical connector for use where a space for insertion and ejection is required to be as small as possible, such for an audio apparatus or a car navigation apparatus which is to be mounted on an automobile.

2. Description of the Prior Art

FIG. 9 the shows main portions of a prior art multipolar plug P which is used in an audio apparatus or the like. The multipolar plug P is a three-pole electrical plug in which a shaft portion 110 having three poles 111, 112, and 113 protrudes from the electrically insulative body 100. The three poles 111, 112, and 113 of the shaft portion 110 are arranged along the axial direction of the shaft portion 110 via insulation rings 121 and 122. In the above-described multipolar plug P, when the shaft portion 110 has a diameter D of 3.5 mm, the shaft portion 110 generally has a length L of about 14 mm. The pole 111 in the base position of the shaft portion 110 has a length L1 of about 4.5 mm, the pole 112 in the middle position has a length L2 of about 2.5 mm, and the pole 113 in the front end position has a length L3 of about 4.5 mm. In the case of a small-sized multipolar plug in which the shaft portion 110 has a diameter D of 2.5 mm, the reference length L of the shaft portion 110 is about 11 mm.

In a multipolar jack serving as a counter electrical connector for the multipolar plug P which is exemplarily shown in FIG. 9, a plurality of poles which respectively correspond to the poles of the multipolar plug P are required to be arranged along the axial direction, and the arrangement direction of the poles must be matched with the insertion direction of the aforementioned plug.

In recent audio apparatuses, car navigation apparatuses, and the like, it is recommended that a space for insertion and ejection when a multipolar plug is to be inserted into or ejected from a multipolar jack located in the apparatus be as small as possible.

In the prior art multipolar plug P shown in FIG. 9, the plurality of poles 111, 112, and 113 disposed on the shaft portion 110 are arranged along the axial direction. In such a case, if the number of poles is increased, it is necessary to increase also the length of the shaft portion 110 in accordance with the increased number of poles. This prevents the shaft portion 110 of the multipolar plug P from being shortened, thereby producing a limitation because of the decrease of the space for insertion into the multipolar jack.

SUMMARY OF THE INVENTION

The present invention was developed in view of the above-mentioned circumstances.

It is an object of the present invention to provide a configuration in which a pin pole, and a plurality of sleeve poles formed of cylinders are coaxially arranged, thereby eliminating the necessity to increase the length of a pole portion even when the number of poles is increased.

It is another object of the present invention to enhance the resistance to deformation of the sleeve poles formed of cylinders.

It is a further object of the present invention to provide a configuration in which the pin pole, which is easily broken is protected by the sleeve poles, thereby preventing the pin pole from being broken.

It is a still further object of the present invention to suppress the total length of the multipolar plug including the body.

The multipolar plug of the present invention is a multipolar electrical plug comprising a body and a plurality of poles, wherein the multipolar electrical plug comprises: a pin pole which protrudes from the body and constitutes one of the plurality of poles; and a plurality of sleeve poles which protrude from the body and constitute the remaining poles of the plurality of poles, the sleeve poles being respectively formed of a plurality of cylinders which are arranged in a coaxial manner with respect to the pin pole.

According to the multipolar plug, even when the number of poles is increased, it is unnecessary to increase the length of the pole portion which is formed of the pin pole and the sleeve poles. This attains the effect in that it is possible to decrease the space for insertion when the multipolar plug is to be inserted into a multipolar jack located in an audio apparatus, a car navigation apparatus, or the like.

The multipolar plug of the present invention may adopt a configuration in which the body is formed of a first cylindrical insulator, a second cylindrical insulator disposed around the first insulator, and a handle cover disposed around the second insulator, the pin pole protrudes from a central position of the first insulator, and the plurality of sleeve poles are individually disposed on an inner peripheral face and an outer peripheral face of the second insulator, respectively.

According to the multipolar plug, the two sleeve poles or the first and second sleeve poles can be reinforced by the inner and outer peripheral faces of the second cylindrical insulator, so that the resistance to deformation of the sleeve poles is enhanced. This enables the useful life period of the multipolar plug to be prolonged.

The multipolar plug of the present invention preferably adopts a configuration in which front ends of the plurality of sleeve poles are disposed at the same level, and a front end position of the pin pole is set at a level which does not protrude from the front end position of the plurality of sleeve poles.

According to the multipolar plug, the whole pin pole including the front end which is thin and easily broken is protected because the pin pole is surrounded by the sleeve poles disposed around it. As a result, the pin pole is hardly broken. Accordingly, also such a configuration can elongate the useful life period of the multipolar plug.

The multipolar plug of the present invention may adopt a configuration in which a neck portion which elongates in a direction crossing the axial direction of the pin pole and the plurality of sleeve poles is continuously integrated with the body, and lead wires which are connected to the pin pole and the plurality of sleeve poles pass through the neck portion.

According to the multipolar plug, the total length of the multipolar plug including the body can be decreased so as to be short. As a result, the total axial length of the multipolar plug can be shortened, and the plug can be easily miniaturized.

DETAILED DESCRIPTION OF THE PREFERRED EMBODIMENT

Figure 1:
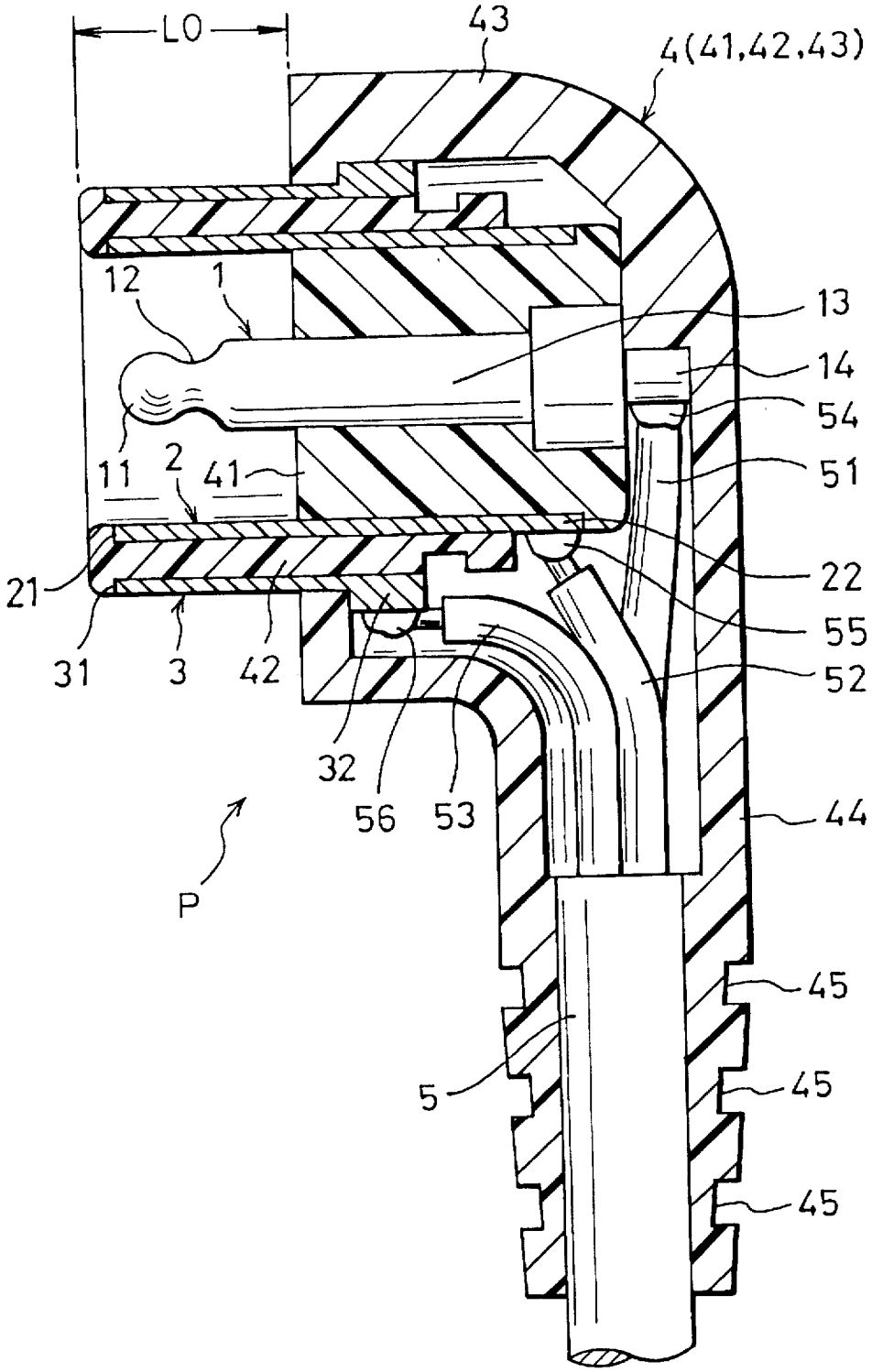
FIG. 1 is a longitudinal section view of a multipolar plug showing an embodiment of the present invention.
Figure 2:
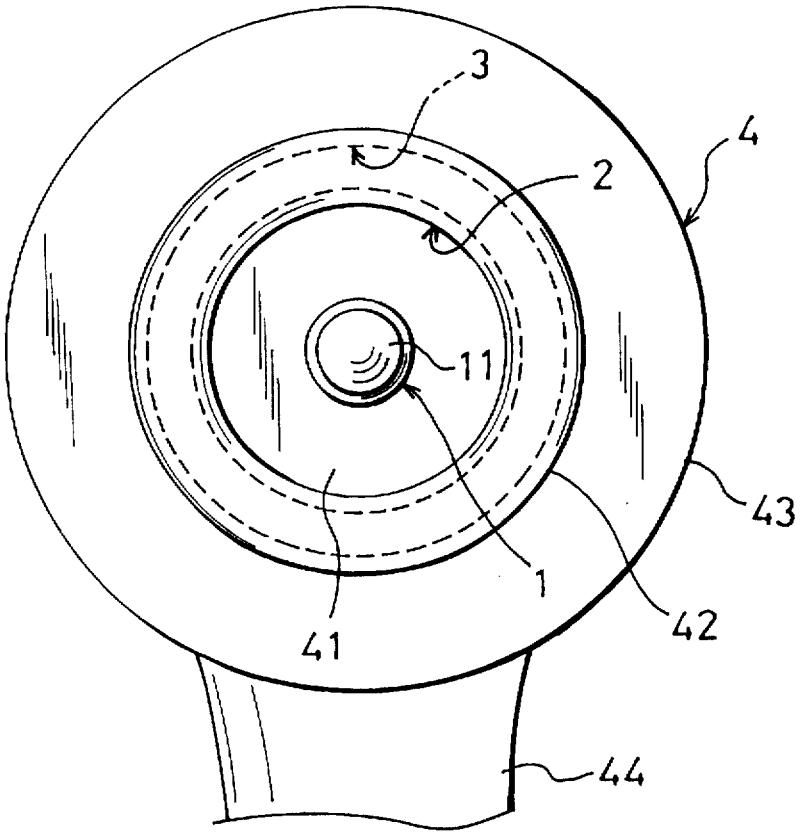
FIG. 2 is a front view of the multipolar plug of FIG. 1.

FIG. 1 is a longitudinal section view of a multipolar plug P showing an embodiment of the present invention, and FIG. 2 is a front view of the multipolar plug P.

The multipolar plug P is of a three-pole type and has three poles 1, 2, and 3. The poles 1, 2, and 3 protrude from the body 4 made of a synthetic resin having a superior electrically insulative property. In the multipolar plug P, the body 4 comprises a first cylindrical insulator 41, a second cylindrical insulator 42 disposed around the first insulator 41, and a handle cover 43. A neck portion 44 which elongates in a direction perpendicularly crossing the axial direction of the poles 1, 2, and 3 is continuously integrated with the handle cover 43. In order to provide the neck portion 44 with flexibility, a plurality of grooves 45 are formed so that portions where the grooves 45 are thin.

The three poles 1, 2, and 3 comprise a pin pole 1, a first sleeve pole 2 formed of a cylinder, and a second sleeve pole 3 formed of a cylinder. The pin pole 1 has a reduced-diameter portion 12 which is adjacent to a spherical head portion 11. A base portion 13 of the pin pole is held in a press fit manner in the center of the first insulator 41. The first sleeve pole 2 is held in a press fit manner in an annular gap formed between the first insulator 41 and the second insulator 42. The second sleeve pole 3 is held in a press fit manner in an annular gap formed between the second insulator 42 and the handle cover 43. The first sleeve pole 2 overlaps the inner peripheral face of the second insulator 42, and the second sleeve pole 3 overlaps the outer peripheral face of the second insulator 42. With such a configuration, the first sleeve pole 2 and the second sleeve pole 3 are reinforced by the second insulator 42, so that they are not easily deformed, that is, they are superior in resistance to deformation. The pin pole 1, the first sleeve pole 2, and the second sleeve pole 3 are disposed in a mutually coaxial manner. The front ends 21 and 31 of the two sleeve poles 2 and 3 are located at the same level. The front end position of the pin pole 1 (i.e., the top of the head portion 11) is located at a level which does not protrude from the front ends 21 and 31 of the sleeve poles 2 and 3. In the illustrated embodiment, the front end position of the pin pole 1 is located at a position which is slightly recessed from the front ends 21 and 31 of the sleeve poles 2 and 3. The second insulator 42 has a front end 42' which engages the front ends 21 and 31 of the sleeve poles 2 and 3, so that the front ends 21 and 31 are not deformed in use.

Terminal portions 14, 22, and 32 are disposed in the rear end portions of the pin pole 1 and the sleeve poles 2 and 3, respectively. Conductors of lead wires 51, 52, and 53 are soldered to the terminal portions 14, 22, and 32, respectively. The reference numerals 54, 55, and 56 designate the soldered portions. The lead wires 51, 52, and 53 pass through the neck portion 44 of the handle cover 43, in the form of one electric wire 5.

Figure 3:
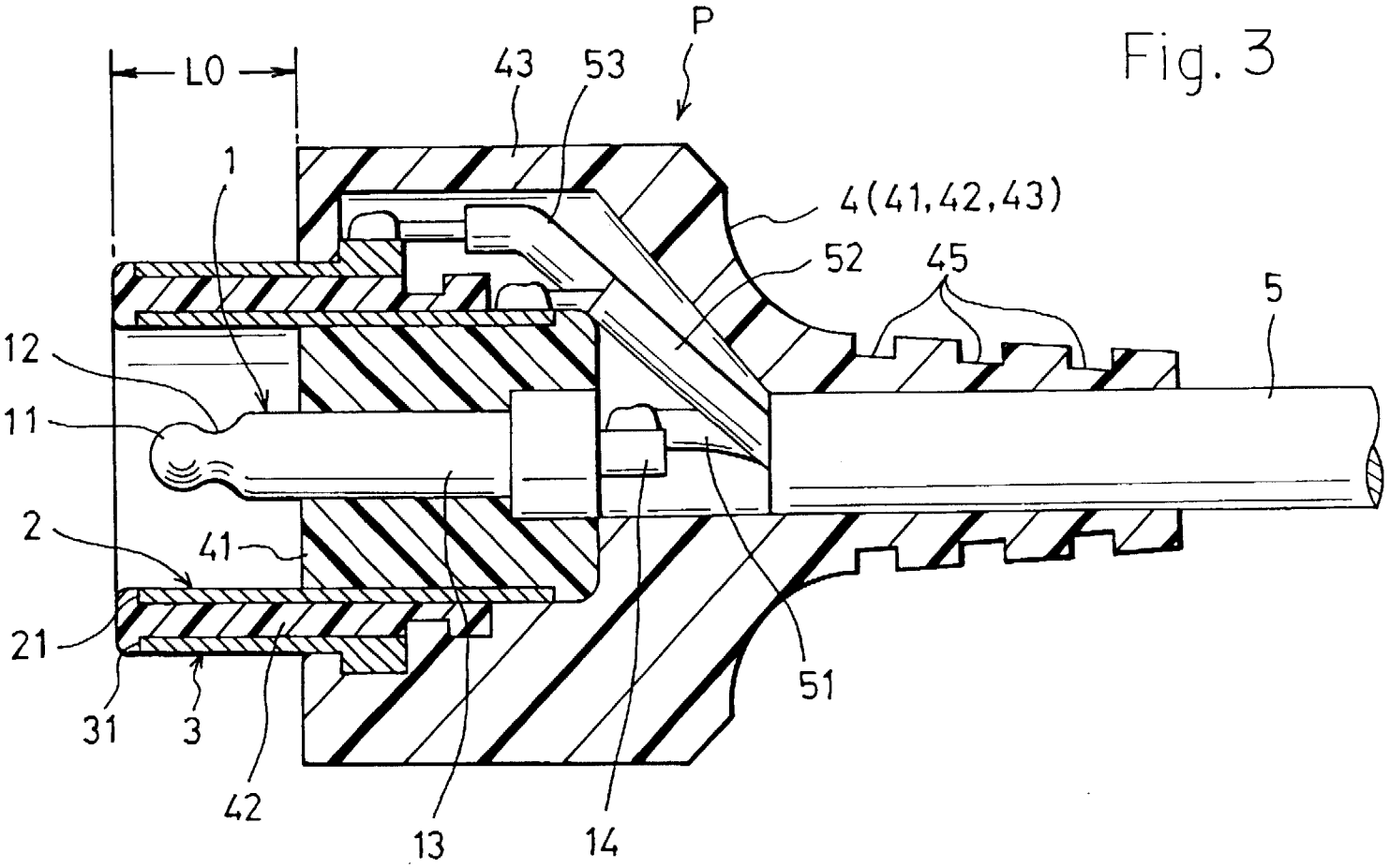
FIG. 3 is a longitudinal section view of a multipolar plug showing another embodiment of the present invention.
Figure 4:
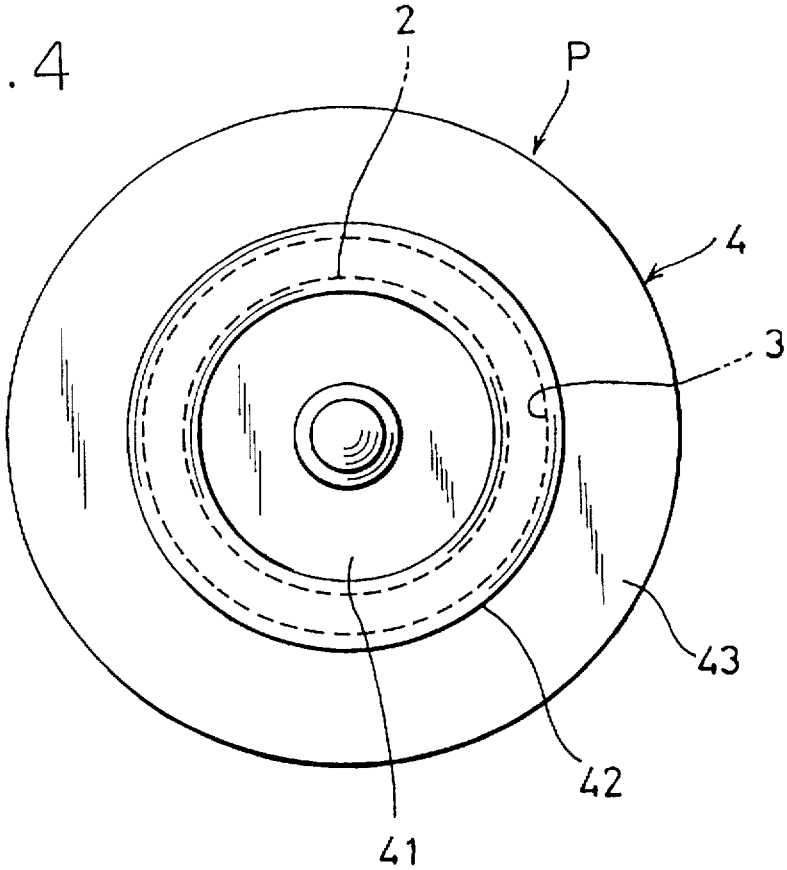
FIG. 4 is a front view of the multipolar plug of FIG. 3.

FIG. 3 is a longitudinal section view of a multipolar plug P showing another embodiment of the present invention, and FIG. 4 is a front view of the multipolar plug P.

This embodiment is different from the embodiment of FIGS. 1 and 2 in that the neck portion 44 of the handle cover 43 elongates in the axial direction of the pin pole 1 and the two sleeve poles 2 and 3. As for the other features, the embodiment is the same as that of FIGS. 1 and 2. In order to simplify the description, the portions identical or corresponding to those illustrated in FIGS. 1 and 2 are designated by the same reference numerals, and their detailed description is omitted.

Figure 9:
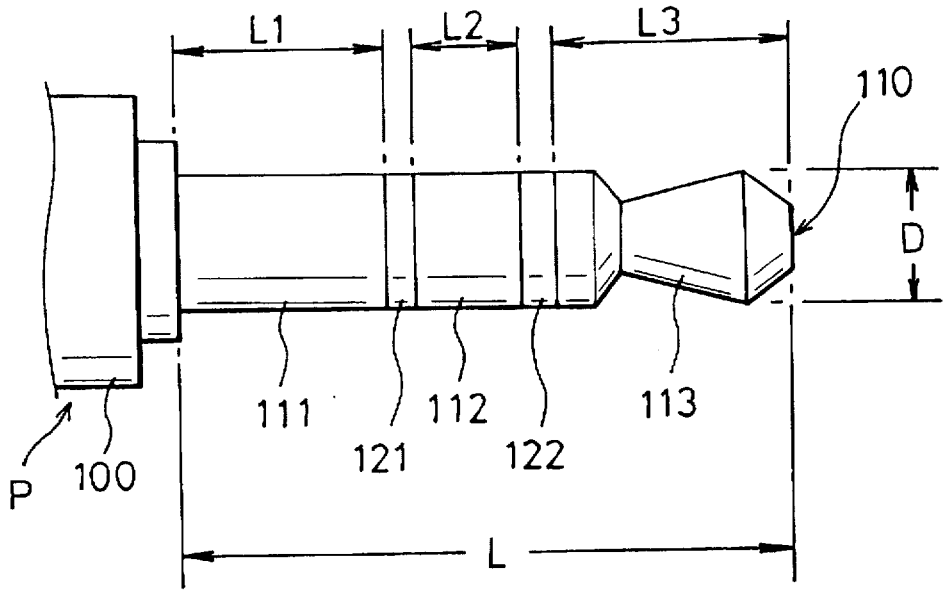
Fig. 9 (PRIOR ART)
FIG. 9 is a side view showing the main portions of a prior art multipolar plug.

The multipolar plug P shown in FIGS. 1 and 2, the multipolar plug P shown in FIGS. 3 and 4 (these two plugs are referred to as "plugs of the present invention"), and the prior art multipolar plug P illustrated in FIG. 9 (this plug is referred to as "prior art plug") are compared with each other. In the prior art plug, three poles 111, 112, and 113 are arranged along the axial direction. In the plugs of the present invention, the three poles 1, 2, and 3 which respectively correspond to the three poles 111, 112, and 113 of the prior art plug are arranged in a coaxial manner. In the plugs of the present invention, therefore, the protruding length L0 of the poles 1, 2, and 3 from the body 4 can be shorter than that of the prior art plug. Specifically, the protruding length L0 could be set so as to be 4.5 mm which is equal to the length L1 of the pole 111 in the base position of the prior art plug. Accordingly, with the plugs of the present invention, the three poles 1, 2, and 3 can be accommodated in the range of the length L1 of the pole 111 in the base position of the prior art plug.

The multipolar plug P shown in FIGS. 1 and 2 (hereinafter referred to as "first plug of the present invention") is compared with the multipolar plug P shown in FIGS. 3 and 4 (hereinafter referred to as "second plug of the present invention"). In the first plug of the present invention, the neck portion 44 of the handle cover 43 elongates in a direction which is perpendicular to the axial direction of the poles 1, 2, and 3. Therefore, the first plug of the present invention is shorter than the second plug of the present invention in which the neck portion 44 of the handle cover 43 elongates in the axial direction of the poles 1, 2, and 3.

Figure 5:
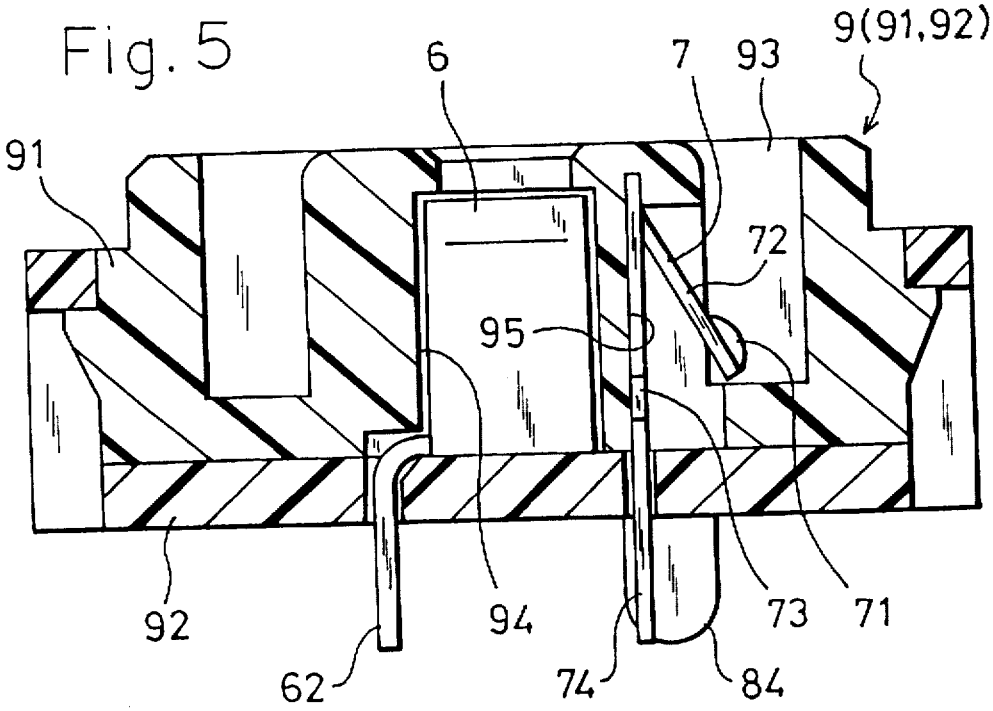
FIG. 5 is a vertical section view showing the internal structure of a multipolar jack which is used as a counter connector for the multipolar plug.
Figure 6:
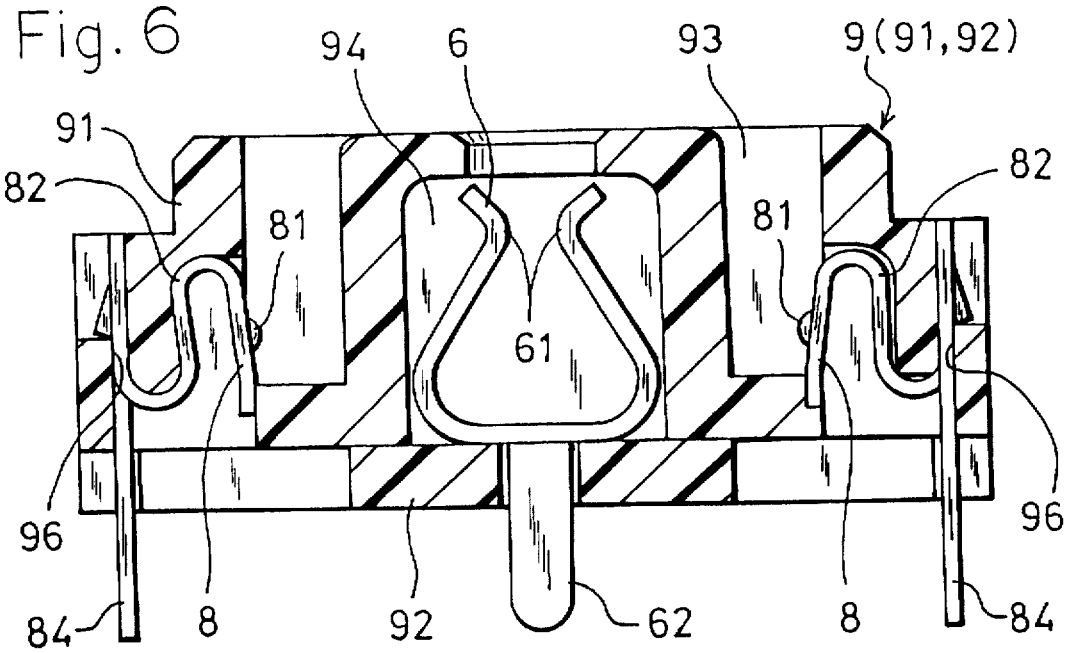
FIG. 6 is a vertical section view showing the internal structure of other portions of the multipolar jack of FIG. 5.
Figure 7:
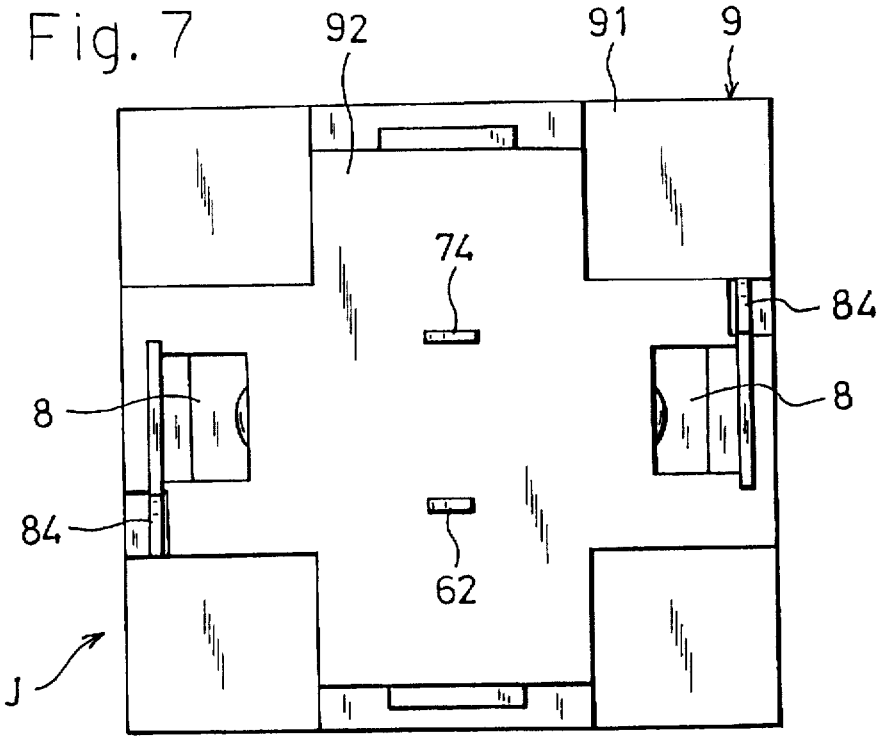
FIG. 7 is a bottom view of the multipolar jack of FIG. 5.

Next, a multipolar jack J used as a counter electrical connector for the multipolar plug P of the present invention will be described. FIG. 5 is a vertical section view showing the internal structure of the multipolar jack J, FIG. 6 is a vertical section view showing the internal structure of other portions of the multipolar jack J, and FIG. 7 is a bottom view of the multipolar jack J.

The multipolar jack J is of a three-pole type, and has three kinds of poles 6, 7, and 8. The poles 6, 7, and 8 are incorporated into the body 9 made of a synthetic resin having a superior electrically insulative property. In the multipolar jack J, the body 9 comprises a body main unit 91 and a cover 92. The body main unit 91 comprises one annular recess 93 which elongates along a virtual coaxial circle, and a center recess 94 positioned at the center of the annular recess 93.

In the multipolar jack J, the three kinds of poles are a center pole 6 disposed in the center recess 94, a first pole 7 disposed on an inner circumferential portion side of the annular recess 93, and two second poles 8 and 8 disposed on an outer circumferential portion side of the annular recess 93. The center pole 6 is formed of a spring member having a pair of contacts 61 which oppose each other. The center pole 6 corresponds to the pin pole 1 of the multipolar plug P of FIGS. 1 to 4. A terminal 62 provided for the center pole 6 protrudes from the back face of the cover 92. The first pole 7 comprises a contact 71 in a front end portion of a raised piece 72 which is formed in the spring member. The contact 71 corresponds to the first sleeve pole 2 of the multipolar plug P of FIGS. 1 to 4. The first pole 7 is pressingly inserted into a groove portion 95 formed in the body main unit 91, and an engagement pawl 73 provided for the first pole 7 is engaged with the body main unit 91, so that the first pole 7 is incorporated into the body main unit 91. A terminal 74 of the first pole 7 protrudes from the back face of the cover 92. Each of the second poles comprises a contact 81 in a front end portion of a meanderous raised piece 82 which is formed in a spring member. The contact 81 corresponds to the second sleeve pole 3 of the multipolar plug P of FIGS. 1 to 4. The second pole 8 is pressingly inserted into a groove portion 96 formed in the body main unit 91. An engagement pawl (not shown) provided for the second pole 8 is engaged with the body main unit 91, so that the second pole 8 is incorporated into the body main unit 91. A terminal 84 of the second pole 8 protrudes from the back face of the cover 92. The pair of second poles 8 are disposed at positions which are separated by 180 degrees from each other.

In the embodiments, a multipolar plug of three-pole type has been described. Alternatively, in present invention, it is possible to construct a multipolar plug having four or more poles. In other words, when sleeve poles the number of which corresponds to the number of poles are provided in a coaxial manner, it is possible to construct a multipolar plug having a required number of poles.

Figure 8:
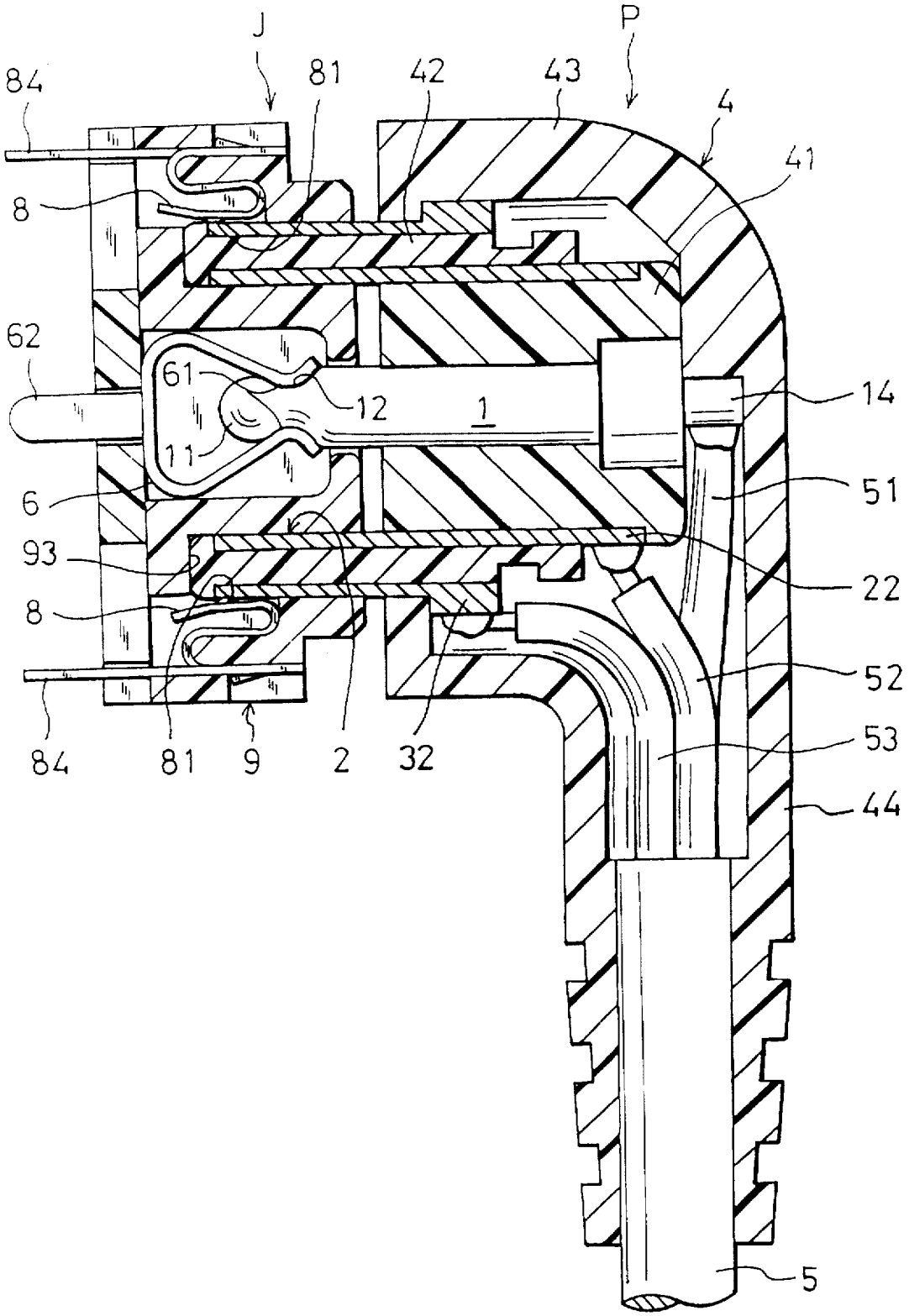
FIG. 8 is a section view showing the connection of the multipolar plug to the multipolar jack.

FIG. 8 shows a section view showing a structure in which the above-described multipolar plug P is connected to the multipolar jack J. As apparent from the figure, the pin pole 1 of the multipolar plug P is inserted into the center recess 94 of the multipolar jack J. The pair of contacts 61 of the center pole 6 are fitted into and resiliently contacted with the reduced-diameter portion 12 of the pin pole 1. The contacts 61 are engaged with the spherical head portion 11, so that the multipolar plug P is prevented from being slipped off. The first sleeve pole 2 and the second sleeve pole 3 of the multipolar plug P are inserted into the annular recess 93 of the multipolar jack J. The contact 71 of the first pole 7 which is not shown in the figure is resiliently contacted with the first sleeve pole 2, and the contacts 81 of the second poles 8 are resiliently contacted with the second sleeve pole 3.

During the insertion of the multipolar plug P into the multipolar jack J, the head portion 11 of the pin pole 1 of the multipolar plug P expands the pair of contacts 61 of the center pole 6 of the multipolar jack J. Immediately after the head portion 11 passes over the pair of contacts 61, the contacts 61 are fitted into the reduced-diameter portion 12. At this time, a click feeling can be obtained.

What is claimed is:

1. A multipolar electrical plug comprising a body and a plurality of poles, wherein said plurality of poles comprise:

a pin pole which protrudes from said body; and a plurality of sleeve poles which protrude from said body, said sleeve poles being respectively formed of a plurality of cylinders which are arranged in a coaxial manner with respect to each other and with respect to said pin pole and which define a front end, and wherein said body includes a cylindrical insulator separating said sleeve poles, said cylindrical insulator having a front end which engages said front ends of said sleeve poles.

2. A multipolar electrical plug according to claim 1, wherein said body includes a handle cover, said handle cover comprising a neck portion which elongates in a direction crossing the axial direction of said pin pole, said plurality of sleeve poles being continuously integrated with said body, and wherein lead wires which are connected to said pin pole and said plurality of sleeve poles pass through said neck portion.

3. A multipolar electrical plug according to claim 1, wherein said body is formed of a first cylindrical insulator defining a central position, and said cylindrical insulator as a second cylindrical insulator disposed around said first insulator, said second cylindrical insulator defining an inner peripheral face and an outer peripheral face, and a handle cover disposed around said second insulator, said pin pole protrudes from said central position of said first insulator, and said plurality of sleeve poles are individually disposed on said inner peripheral face and said outer peripheral face, respectively of said second insulator.

4. A multipolar electrical plug according to claim 3, wherein said handle cover includes a neck portion which elongates in a direction crossing the axial direction of said pin pole, said plurality of sleeve poles being continuously integrated with said body, and wherein lead wires which are connected to said pin pole and said plurality of sleeve poles pass through said neck portion.

5. A multipolar electrical plug according to claim 1, wherein with said front ends are disposed at the same level, wherein said pin pole defines a front end, and wherein the front end of said pin pole is set at a level which does not protrude from the front end position of said plurality of sleeve poles.

6. A multipolar electrical plug according to claim 5, wherein said body includes a handle cover, said handle cover comprising a neck portion which elongates in a direction crossing the axial direction of said pin pole, said plurality of sleeve poles being continuously integrated with said body, and wherein lead wires which are connected to said pin pole and said plurality of sleeve poles pass through said neck portion.

7. A multipolar electrical plug according to claim 3, wherein said pin pole defines a front end, and wherein the front ends of said plurality of sleeve poles are disposed at the same level, and the front end of said pin pole is set at a level which does not protrude from the front end positions of said plurality of sleeve poles.

8. A multipolar electrical plug according to claim 7, wherein said handle cover includes a neck portion which elongates in a direction crossing the axial direction of said pin pole, said plurality of sleeve poles being continuously integrated with said body, and wherein lead wires which are connected to said pin pole and said plurality of sleeve poles pass through said neck portion.

* * * * *